US006186852B1

(12) United States Patent
Davis

(10) Patent No.: US 6,186,852 B1
(45) Date of Patent: Feb. 13, 2001

(54) TOY BANK

(76) Inventor: Doris J. Davis, 816 Waverly Dr., Arlington, TX (US) 76015

( * ) Notice: Under 35 U.S.C. 154(b), the term of this patent shall be extended for 0 days.

(21) Appl. No.: 09/121,332

(22) Filed: Jul. 23, 1998

(51) Int. Cl.[7] ..... A63H 3/00; A45C 1/12
(52) U.S. Cl. ..... 446/8; 446/73
(58) Field of Search ..... 446/8, 9, 12, 73, 446/223, 226, 390; D21/613, 624

(56) References Cited

U.S. PATENT DOCUMENTS

| | | | | |
|---|---|---|---|---|
| Re. 24,355 | * | 9/1957 | Whalen | 446/8 |
| D. 62,766 | * | 7/1923 | Zimmerman . | |
| 1,229,906 | * | 6/1917 | Decker | 446/73 |
| 1,242,820 | * | 10/1917 | Levay et al. | 446/8 |
| 2,650,452 | * | 9/1953 | Martin . | |
| 3,831,313 | * | 8/1974 | Cichy | 446/8 |
| 4,345,400 | * | 8/1982 | Katzman et al. . | |
| 4,401,259 | * | 8/1983 | Knutson | 446/8 |
| 4,815,999 | * | 3/1989 | Ayon et al. | 446/73 |
| 5,059,149 | * | 10/1991 | Stone | 446/73 |
| 5,092,778 | * | 3/1992 | Shaver et al. | 446/73 |

FOREIGN PATENT DOCUMENTS

| | | | | |
|---|---|---|---|---|
| 828763 | * | 2/1960 | (GB) | 446/226 |

* cited by examiner

*Primary Examiner*—Robert A. Hafer
*Assistant Examiner*—Jeffrey D. Carlson

(57) ABSTRACT

A toy bank for saving coins therein. The device includes a stuffed doll having an exterior configured to resemble a predetermined figure. The stuffed doll has stuffed head and body portions each configured to resemble the head and body of the predetermined figure. The body portion has an interior, a top, a bottom, a front and a back. The bottom of the body portion is adapted for resting on a surface such that the head and body portions are generally vertical with respect to the surface. A container is provided in the interior of the body portion. The body portion has a slot into the container adapted for inserting coins into the container. The slot is located on the back of the body portion towards the top of the body portion. The body portion has a hole into the container adapted for removing coins disposed in the container. The hole is located on the back of the body portion towards the bottom of the body portion.

1 Claim, 2 Drawing Sheets

TOY BANK

BACKGROUND OF THE INVENTION

1. Field of the Invention

The present invention relates to toy banks and more particularly pertains to a new toy bank for saving coins therein.

2. Description of the Prior Art

The use of toy banks is known in the prior art. More specifically, toy banks heretofore devised and utilized are known to consist basically of familiar, expected and obvious structural configurations, notwithstanding the myriad of designs encompassed by the crowded prior art which have been developed for the fulfillment of countless objectives and requirements.

Known prior art toy banks include U.S. Pat. No. 4,345,400; U.S. Pat. No. 5,580,292; U.S. Pat. No. 4,401,259; U.S. Pat. No. 2,472,064; U.S. Pat. No. Des. 139,465; and U.S. Pat. No. 5,304,087.

While these devices fulfill their respective, particular objectives and requirements, the aforementioned patents do not disclose a new toy bank. The inventive device includes a stuffed doll having an exterior configured to resemble a predetermined figure. The stuffed doll has stuffed head and body portions each configured to resemble the head and body of the predetermined figure. The body portion has an interior, a top, a bottom, a front and a back. The bottom of the body portion is adapted for resting on a surface such that the head and body portions are generally vertical with respect to the surface. A container is provided in the interior of the body portion. The body portion has a slot into the container adapted for inserting coins into the container. The slot is located on the back of the body portion towards the top of the body portion. The body portion has a hole into the container adapted for removing coins disposed in the container. The hole is located on the back of the body portion towards the bottom of the body portion.

In these respects, the toy bank according to the present invention substantially departs from the conventional concepts and designs of the prior art, and in so doing provides an apparatus primarily developed for the purpose of saving coins therein.

SUMMARY OF THE INVENTION

In view of the foregoing disadvantages inherent in the known types of toy banks now present in the prior art, the present invention provides a new toy bank construction wherein the same can be utilized for saving coins therein.

The general purpose of the present invention, which will be described subsequently in greater detail, is to provide a new toy bank apparatus and method which has many of the advantages of the toy banks mentioned heretofore and many novel features that result in a new toy bank which is not anticipated, rendered obvious, suggested, or even implied by any of the prior art toy banks, either alone or in any combination thereof.

To attain this, the present invention generally comprises a stuffed doll having an exterior configured to resemble a predetermined figure. The stuffed doll has stuffed head and body portions each configured to resemble the head and body of the predetermined figure. The body portion has an interior, a top, a bottom, a front and a back. The bottom of the body portion is adapted for resting on a surface such that the head and body portions are generally vertical with respect to the surface. A container is provided in the interior of the body portion. The body portion has a slot into the container adapted for inserting coins into the container. The slot is located on the back of the body portion towards the top of the body portion. The body portion has a hole into the container adapted for removing coins disposed in the container. The hole is located on the back of the body portion towards the bottom of the body portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new toy bank apparatus and method which has many of the advantages of the toy banks mentioned heretofore and many novel features that result in a new toy bank which is not anticipated, rendered obvious, suggested, or even implied by any of the prior art toy banks, either alone or in any combination thereof.

It is another object of the present invention to provide a new toy bank which may be easily and efficiently manufactured and marketed.

It is a further object of the present invention to provide a new toy bank which is of a durable and reliable construction.

An even further object of the present invention is to provide a new toy bank which is susceptible of a low cost of manufacture with regard to both materials and labor, and which accordingly is then susceptible of low prices of sale to the consuming public, thereby making such toy bank economically available to the buying public.

Still yet another object of the present invention is to provide a new toy bank which provides in the apparatuses and methods of the prior art some of the advantages thereof, while simultaneously overcoming some of the disadvantages normally associated therewith.

Still another object of the present invention is to provide a new toy bank for saving coins therein.

Yet another object of the present invention is to provide a new toy bank which includes a stuffed doll having an exterior configured to resemble a predetermined figure. The stuffed doll has stuffed head and body portions each configured to resemble the head and body of the predetermined figure. The body portion has an interior, a top, a bottom, a front and a back. The bottom of the body portion is adapted for resting on a surface such that the head and body portions are generally vertical with respect to the surface. A container is provided in the interior of the body portion. The body portion has a slot into the container adapted for inserting coins into the container. The slot is located on the back of the body portion towards the top of the body portion. The body portion has a hole into the container adapted for removing coins disposed in the container. The hole is located on the back of the body portion towards the bottom of the body portion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
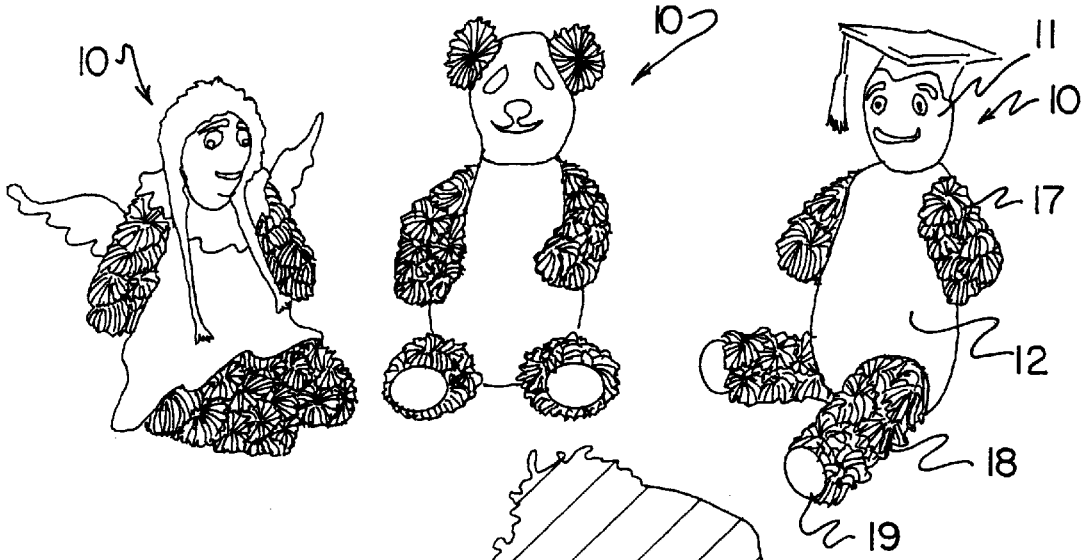
FIG. 1 is a schematic front side view of several new toy banks configured to resemble various figures according to the present invention.
Figure 2:
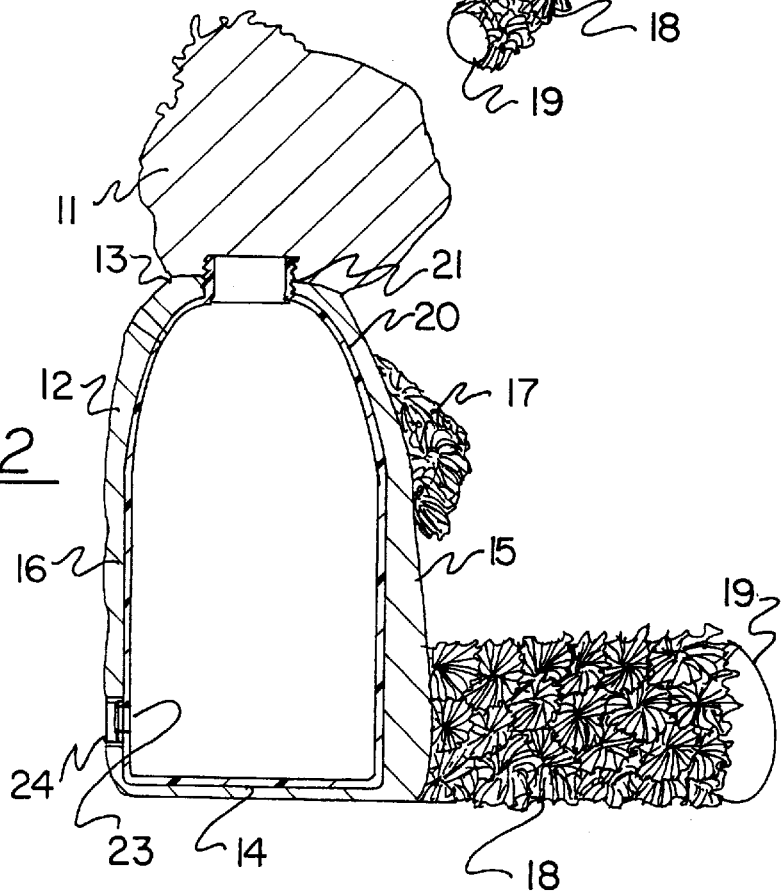
FIG. 2 is a schematic cross sectional view of the present invention.
Figure 3:
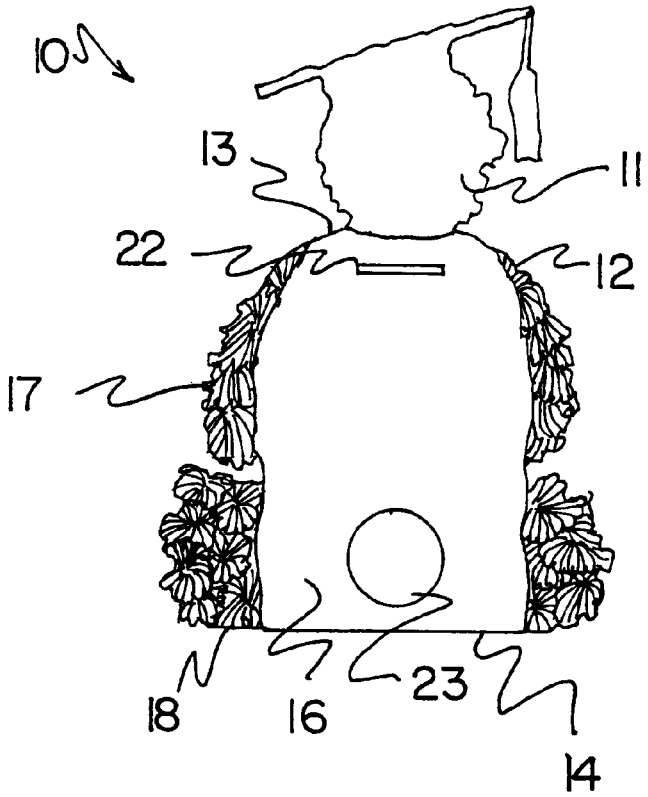
FIG. 3 is a schematic back side view of the present invention.
Figure 4:
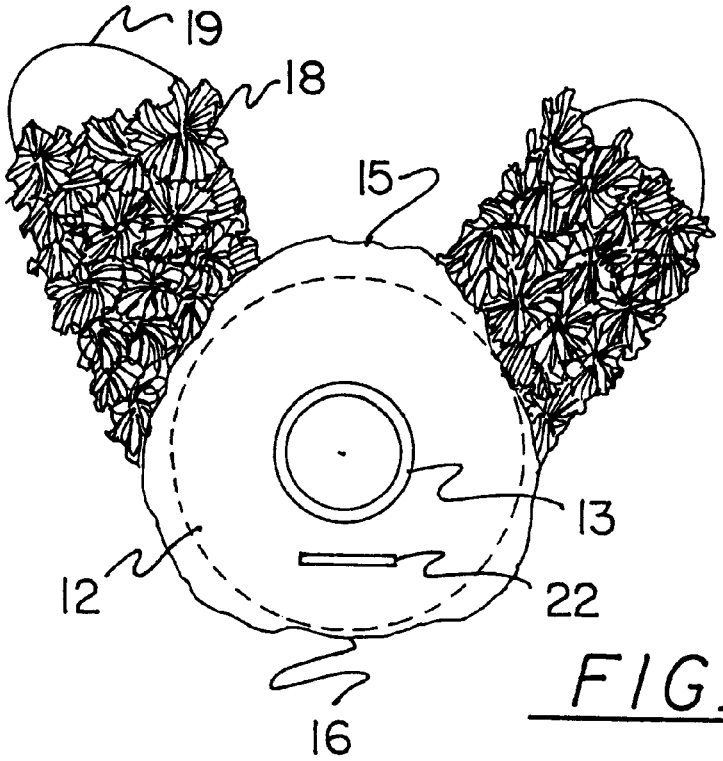
FIG. 4 is a schematic top side view of the present invention with the head portion detached from the body portion.

With reference now to the drawings, and in particular to FIGS. 1 through 4 thereof, a new toy bank embodying the principles and concepts of the present invention and generally designated by the reference numeral 10 will be described.

As best illustrated in FIGS. 1 through 4, the toy bank 10 generally comprises a stuffed doll having an exterior configured to resemble a predetermined figure. The stuffed doll has stuffed head and body portions 11,12 each configured to resemble the head and body of the predetermined figure. The body portion 12 has an interior, a top 13, a bottom 14, a front 15 and a back 16. The bottom 14 of the body portion 12 is adapted for resting on a surface such that the head and body portions 11,12 are generally vertical with respect to the surface. A container 20 is provided in the interior of the body portion 12. The body portion 12 has a slot 22 into the container 20 adapted for inserting coins into the container 20. The slot 22 is located on the back 16 of the body portion 12 towards the top 13 of the body portion 12. The body portion 12 has a hole 23 into the container 20 adapted for removing coins disposed in the container 20. The hole 23 is located on the back 16 of the body portion 12 towards the bottom 14 of the body portion 12.

In closer detail, the stuffed doll has a fabric exterior configured to resemble a predetermined figure. The stuffed doll has stuffed head and body portions 11,12 each configured to resemble the head and body of the predetermined figure. The body portion 12 has an interior, a top 13, a bottom 14, a front 15 and a back 16. The head portion 11 is coupled to the top 13 of the body portion 12. The bottom 14 of the body portion 12 is adapted for resting on a surface such that the head and body portions 11,12 are generally vertical with respect to the surface. The stuffed doll has a plurality of limb portions 17,18 coupled to the body portion 12. The limb portions preferably extend from the front 15 of the body portion 12. The limb portions are configured to resemble the limbs of the predetermined figure and include arm limb portions 17 located towards the top 13 of the body portion 12 and leg limb portions 18 located towards the bottom 14 of the body portion 12. Preferably, the limb portions comprise a series of connected yarn pompoms. The limb portions each have a free end. The leg limb portions 18 preferably each have a foot portion 19 coupled to the free end. Each foot portion 19 is configured to resemble a foot of the predetermined figure. Preferably, each foot portion 19 comprises a balloon stuffed with a stuffing material.

A container 20 such as a plastic beverage bottle with a constricted neck 21 is provided in the interior of the body portion 12. The neck 21 is positioned towards the top 13 of the body member. The body portion 12 has a slot 22 into the container 20 adapted for inserting coins into the container 20. The slot 22 is located on the back 16 of the body portion 12 towards the top 13 of the body portion 12. Preferably, the slot 22 has a length extending in a horizontal direction generally perpendicular to a vertical line extending between the top 13 and bottom 14 of the body portion 12. The body portion 12 also has a generally circular hole 23 into the container 20 adapted for removing coins disposed in the container 20. The hole 23 is located on the back 16 of the body portion 12 towards the bottom 14 of the body portion 12 and spaced apart from the slot 22. Preferably, a removable plug 24 substantially closes the hole 23 to prevent accidental spilling of coins from inside the container 20.

Preferably, the stuffed doll has an length greater than about 12 inches. Preferably, the head and body portions 11,12 has a height measured from the bottom 14 of the body portion 12 greater than about 10 inches. Preferably, the body has a width of greater than about 4 inches. In an ideal illustrative embodiment, the length is about 18 inches, the height of the head and body portions is about 12 inches and the width of the body portion is between about 5 and 7 inches.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toy bank, comprising:

a stuffed doll having a fabric exterior configured to resemble a predetermined figure;

said stuffed doll having stuffed head and body portions each configured to resemble the head and body of the predetermined figure, said head of said stuffed doll having a threaded recess formed on a bottom thereof;

said body portion having an interior, a top, a bottom, a front and a back, said head portion being coupled to said top of said body portion, said bottom of said body portion being adapted for resting on a surface such that said head and body portions are generally vertical with respect to the surface;

said stuffed doll having a plurality of limb portions coupled to said body portion, said limb portions extending from said front of said body portion, said limb portions being configured to resemble the limbs of the predetermined figure and including arm limb portions located towards said top of said body portion and leg limb portions located towards said bottom of said body portion;

wherein said limb portions comprise a series of connected yarn pompoms;

said limb portions each having a free end, said leg limb portions having a foot portion coupled to said free end, each foot portion being configured to resemble a foot of the predetermined figure, wherein each foot portion is stuffed with a stuffing material;

a container including a plastic bottle having a substantially cylindrical lower portion with a circular cross-section and a constricted neck being provided in said interior of said body portion, said neck being positioned towards said top of said body member and extending therefrom with threads formed therein, wherein said neck is inserted within said recess of said head of said stuffed doll;

a slot being formed in said container and adapted for inserting coins into said container, said slot being located on said back of said body portion towards said top of said body portion, said slot having a length extending in a horizontal direction generally perpendicular to a vertical line extending between said top and bottom of said body portion;

a generally circular hole being formed in said container and adapted for removing coins disposed in said container, said hole being located on said back of said body portion towards said bottom of said body portion and spaced apart from said slot;

a removable plug substantially closing said hole to prevent accidental spilling of coins from inside the container; and wherein said stuffed doll has an length greater than about 12 inches, wherein said head and body portions having a height measured from said bottom of said body portion greater than about 10 inches, wherein said body has a width of greater than about 4 inches.

* * * * *